US009168748B2

(12) United States Patent
Borrego Lebrato et al.

(10) Patent No.: US 9,168,748 B2
(45) Date of Patent: Oct. 27, 2015

(54) NOZZLE ARRAYS

(71) Applicant: Hewlett-Packard Development Company, L.P., Houston, TX (US)

(72) Inventors: Alberto Borrego Lebrato, Barcelona (ES); David Chanclón Fernández, Barcelona (ES); Martin Urrutia Nebreda, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/429,277

(22) PCT Filed: Sep. 20, 2012

(86) PCT No.: PCT/US2012/056358

§ 371 (c)(1),
(2) Date: Mar. 18, 2015

(87) PCT Pub. No.: WO2014/046661

PCT Pub. Date: Mar. 27, 2014

(65) Prior Publication Data

US 2015/0224767 A1 Aug. 13, 2015

(51) Int. Cl.

| | |
|---|---|
| ***B41J 2/21*** | (2006.01) |
| ***B41J 2/14*** | (2006.01) |
| ***B41J 2/045*** | (2006.01) |

(52) U.S. Cl.
CPC ..... *B41J 2/1433* (2013.01); *B41J 2/04505* (2013.01); *B41J 2/04586* (2013.01)

(58) Field of Classification Search
CPC .. B41J 2202/21; B41J 2/16585; B41J 2/1442; B41J 2/14; B41J 2/51; B41J 2202/15
USPC ..... 347/9–12, 15, 20, 37, 40, 42, 47, 49
See application file for complete search history.

(56) References Cited

U.S. PATENT DOCUMENTS

| | | | | |
|---|---|---|---|---|
| 6,155,669 | A | 12/2000 | Donahue et al. | |
| 6,198,897 | B1 | 3/2001 | Ream | |
| 6,305,780 | B1 | 10/2001 | Askren et al. | |
| 6,672,705 | B2 * | 1/2004 | Kitahara et al. | 347/42 |
| 7,712,739 | B2 | 5/2010 | Yoshimizu | |
| 7,794,042 | B2 | 9/2010 | Mizes et al. | |
| 2004/0056913 | A1 | 3/2004 | Kniazzeh et al. | |
| 2006/0103691 | A1 | 5/2006 | Dietl et al. | |
| 2009/0160900 | A1 | 6/2009 | Niida et al. | |
| 2012/0223990 | A1 | 9/2012 | Tanoue et al. | |

OTHER PUBLICATIONS

International Search Report and Written Opinion dated Jan. 21, 2013, issued on PCT Patent Application No. PCT/US2012/056358 dated Sep. 20, 2012, European Patent Office.

* cited by examiner

*Primary Examiner* — Thinh Nguyen

(57) ABSTRACT

Disclosed are devices and methods where a distance between nozzle arrays is equal to a substrate advance distance corresponding to at least one complete turn of a rotating drive body.

15 Claims, 4 Drawing Sheets

NOZZLE ARRAYS

CLAIM FOR PRIORITY

The present application is a national stage filing under 35 U.S.C 371 of PCT application number PCT/US2012/056358, having an international filing date of Sep. 20, 2012, the disclosure of which is hereby incorporated by reference in its entirety.

BACKGROUND

Fluid ejection devices are provided with fluid ejection heads for ejecting fluid onto a substrate. Fluid ejection heads are provided with one or more nozzle arrays for ejecting the fluid. Some fluid ejection devices are provided with successive nozzle arrays or print bars that are arranged successively and parallel to a substrate advance direction. Drive systems advance the substrate with respect to the successive nozzle arrays during fluid ejection. The drive systems can exhibit tolerances or imperfections.

BRIEF DESCRIPTION OF THE DRAWINGS

For the purpose of illustration, certain examples constructed in accordance with the teachings of this disclosure will now be described with reference to the accompanying drawings, in which.

DETAILED DESCRIPTION

In the following detailed description, reference is made to the accompanying drawings. The examples in the description and drawings should be considered illustrative and are not to be considered as limiting to the specific example or element described. Multiple examples may be derived from the following description and/or drawings through modification, combination or variation of certain elements. Furthermore, it may be understood that examples or elements that are not literally described may be derived from the description and drawings.

In an example an inaccuracy in a relative position of a printed dot is called a registration error. A registration error refers to an unintended displacement of a first dot with respect to a second dot. For example, when two dots that were intended to be printed on the same location of a substrate are printed with a slight displacement, this is called a registration error. A tolerance or imperfection in a drive system element may cause registration errors. In certain examples concentricity errors and axial or radial run out in a pulley may cause registration errors. Known fluid ejection devices are oftentimes continuously calibrated during printing to reduce registration error. Oftentimes, registration errors are periodical. For example registration errors due to eccentricity or run out of a pulley are periodical.

Figure 1:
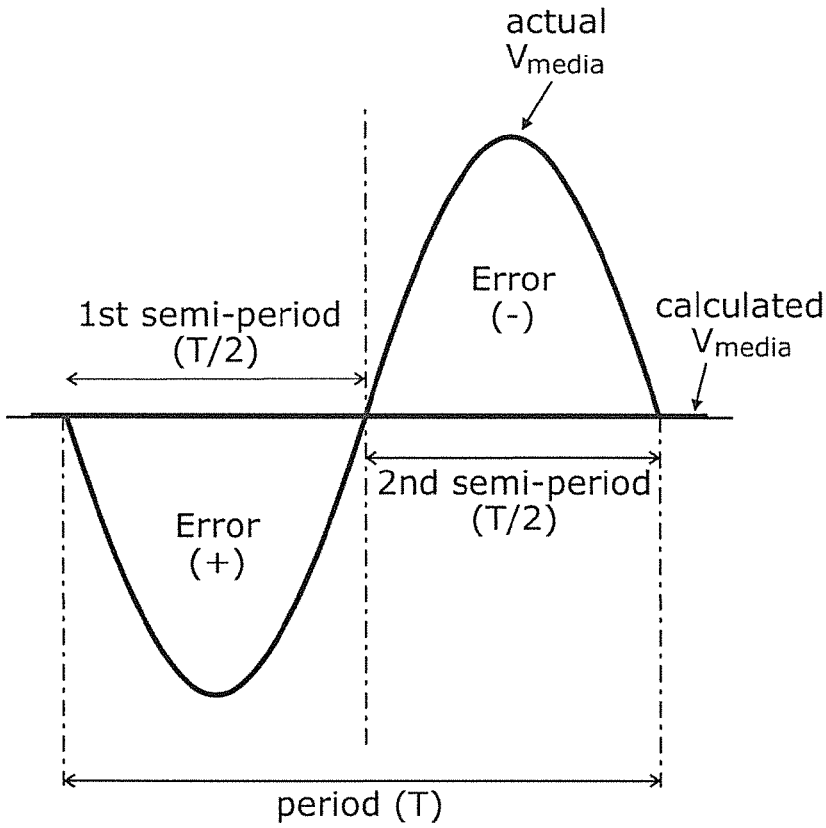
FIG. 1 illustrates an example of a function containing a periodic error plotting an actual substrate advance speed against a calculated substrate advance speed.

FIG. 1 illustrates an example of a function of an actual substrate advance speed ($V_{media}$) on a vertical axis plotted against time on a horizontal axis, of an example fluid ejection device. The illustrated time interval covers one period (T). The graph illustrates an example periodical error (+, −), for example caused by eccentricity or run out of a pulley with respect to its encoder. The "calculated" substrate advance speed is the speed that a control circuit of the fluid ejection device reads from the encoder. The "actual" substrate advance speed is obtained by measuring the speed of the advancing substrate or conveyor belt directly, for example not through the encoder, for example by using an external measuring device. The graph illustrates a periodic error between the actual substrate advance speed and the calculated substrate advance speed. In the illustrated example, the graph illustrates a first periodic error corresponding to an actual substrate advance speed (−) that is lower than the calculated substrate advance speed in a first semi-period (T/2), and a second periodic error corresponding to an actual substrate advance speed (+) that is higher than the calculated substrate advance speed in a second semi-period (T/2). For example, the differences between the actual and the calculated substrate advance speed are not read by the encoder and therefore it may be difficult to compensate for the periodic error in conventional print devices.

Figure 2:
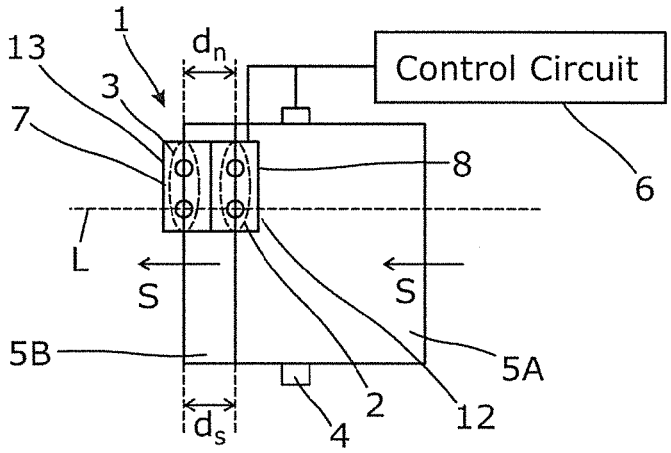
FIG. 2 illustrates a diagrammatic top view of an example of a fluid ejection device.
Figure 3:
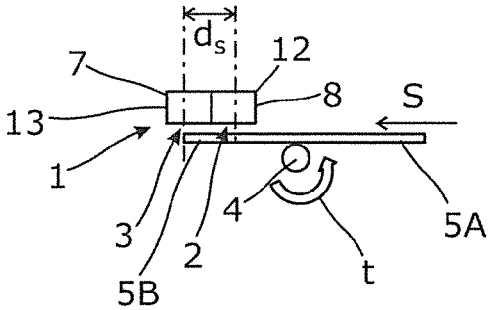
FIG. 3 illustrates a diagrammatic side view of the example fluid ejection device of FIG. 2.

FIG. 2 shows a diagram of an example of a fluid ejection device 1 in top view and FIG. 3 shows a diagram of the same example fluid ejection device 1 in a cross sectional side view. The fluid ejection device 1 includes a first nozzle array 2. The fluid ejection device 1 includes a second nozzle array 3 that is arranged downstream of the first nozzle array 2. In the illustrated example, each nozzle array 2, 3 includes at least one line of nozzles that is arranged approximately perpendicular to a substrate advance direction S. In other examples each nozzle array 2, 3 includes multiple rows and/or columns of nozzles. In further examples, the first nozzle array 2 is provided in a first print bar 12 and the second nozzle array 3 is provided in a second print bar 13 that is arranged downstream of, and parallel to, the first print bar 12, the nozzle arrays 2, 3 having the same relative positions within each respective print bar 12, 13. In again further examples, the first and second nozzle array 2, 3 are provided in respective first and second print heads or in respective first and second print head dies. For example, a pitch $d_n$ of the first and second nozzle arrays 2, 3 refers to one of a nozzle array pitch, a print head die pitch, a print head pitch or a print bar pitch.

The fluid ejection device 1 includes a drive system. In the illustrated example, the drive system includes a rotating body 4 for advancing a substrate 5A, 5B with respect to the nozzle arrays 2, 3. For example, the rotating body 4 include a conveyer belt pulley or a substrate advance roller. For example, the rotating body 4 is one of multiple elements of a substrate drive system. For example, the rotating body 4 includes at least one of a transmission, gears, pinch rollers, active or idle pulleys, rollers, etc. For example, the drive system includes a conveyor belt. FIG. 2 further illustrates a control circuit 6 for instructing the nozzles to eject fluid, and instructing the drive system to advance the substrate. For example, the control circuit 6 includes a processing circuit and a memory circuit. For example, the control circuit 6 includes an analogue and digital application specific integrated circuit.

FIGS. 2 and 3 illustrate two instances of the substrate 5A and 5B, wherein a second instance of the substrate 5B has advanced over a substrate advance distance $d_s$ with respect to a first instance 5A of the substrate. In this example the substrate advance distance $d_s$ is a result of one complete turn of 360 degrees of the rotating body 4. In an example, the pitch $d_n$ of the first and second nozzle array 2, 3 is equal to the said substrate advance distance $d_s$ that is the result of said one complete turn of the rotating body 4.

In other examples, the pitch $d_n$ of the first and second nozzle array 2, 3 equals a substrate advance distance $d_s$ that is a result of multiple complete turns of the rotating body 4. At least one complete turn can be defined as an integer number of complete turns, for example one, two or higher, wherein the starting position of the rotating body 4 is the same as the end position after the complete turn(s).

For example, the pitch $d_n$ of the first and second nozzle array 2, 3 is defined as being the distance between corresponding points of parallel nozzle arrays 2, 3 that reside on a line L that is parallel to the substrate advance direction S. The line L should be construed as an imaginary line that is herein referred to for the purpose of explanation. For example, the distance between the first and second nozzle array 2, 3 can be measured between center points of corresponding nozzles of each nozzle array 2, 3 or each print bar 12, 13.

In an example, one complete turn of the rotating body 4 corresponds to one period T of a periodic error function, such as illustrated in FIG. 1. In theory, in one complete turn of the rotating body 4 the substrate 5A, 5B always advances the same distance $d_s$, irrespective of the periodical error, while between non-complete turns the substrate advance distance $d_s$ can be challenging to predict for example due to eccentricity or run out of the rotating body. Therefore, one can compensate for a periodical error by setting the pitch $d_n$ of the first and second nozzle array 2, 3 equal to the distance $d_s$ that the substrate 5A, 5B travels in one complete period T, or a higher integer number of complete periods T. In an example of a fluid ejection device 1 that includes print bars 12, 13 the pitch $d_n$ of the print bars 12, 13 is set equal to the distance that the substrate 5A, 5B travels in said at least one complete period T.

In a first example, successive print bars 12, 13 directly follow one another, while in a second example, at least one additional nozzle array, print head die, print head or print bar can be arranged between said first and second print bar 12, 13.

In an example, the control circuit 6 is configured to instruct a first nozzle actuator to print a first dot out of a first nozzle of the first nozzle array 2 onto a substrate 5B, and a second nozzle actuator to print a second dot out of a second nozzle of the second nozzle array 3 at a predetermined distance with respect to the first dot. For example, the control circuit 6 is configured to instruct the second nozzle actuator to print onto the same location as the first dot. For example, the actuators include at least one of thermal resistors or piezo resistors. For example by setting the nozzle array pitch $d_n$ equal to a substrate advance distance $d_s$ of one or more complete turns t of the rotating body 4, the instructed first and second dots can be printed with a nozzle registration error of zero, or at least a reduced or negligible nozzle registration error with respect to conventional error compensation solutions.

Figure 4:
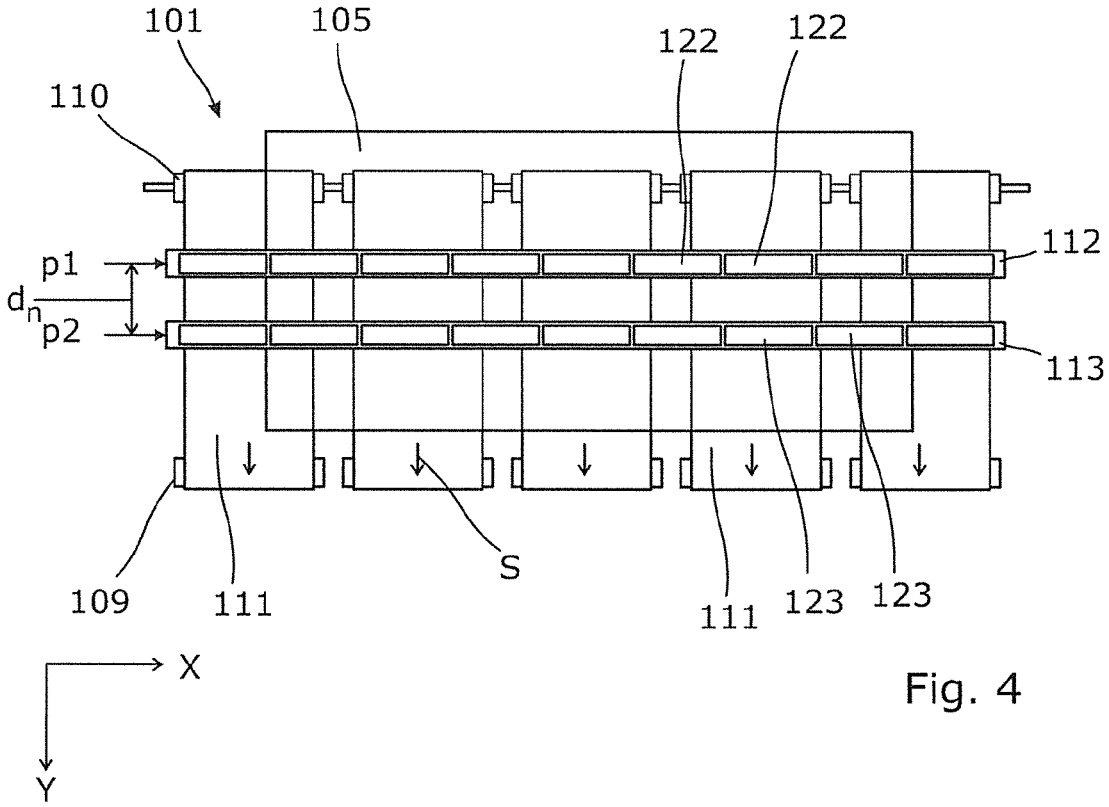
FIG. 4 illustrates a diagrammatic top view of another example of a fluid ejection device.
Figure 5:
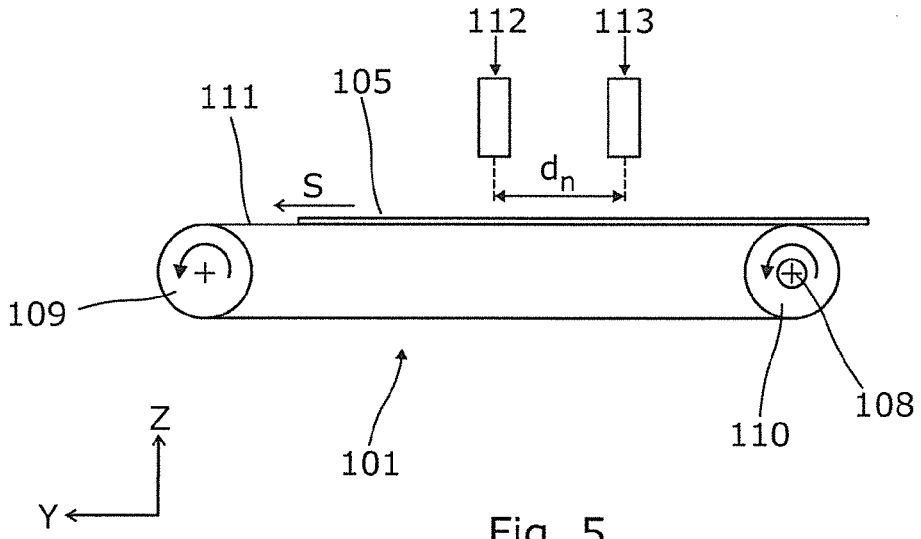
FIG. 5 illustrates a diagrammatic side view of the example fluid device of FIG. 4.

FIG. 4 illustrates another example of a portion of a fluid ejection device 101, in a diagrammatic top view. FIG. 5 illustrates the same example in a diagrammatic side view. The fluid ejection device 101 includes multiple print bars 112, 113 for example to increase the number or density of ink colors, or to compensate for possible nozzle defects. The fluid ejection device 101 includes a first and a second substrate wide array print bar 112, 113 that are arranged in parallel, perpendicularly to the substrate advance direction S. For example, a substrate wide print bar is referred to as a page wide array (PWA) print bar. In the illustrated examples the print bars 112, 113 cover the width of a print zone. In other examples, print bars cover a print zone or substrate only partially.

For example, the fluid ejection device 101 further includes a drive pulley 109 and an idle pulley 110. For example, the idle pulley 110 is connected to an encoder 108. In an example, a control circuit of the fluid ejection device 101 calculates and controls a substrate advance speed by reading the encoder 108. The fluid ejection device 101 further includes a conveyor belt 111 driven by the pulleys 109, 110. The conveyor belt 111 is arranged to advance the substrate 105 with respect to the print bars 112, 113, in a substrate advance direction S.

For example, each print bar 112, 113 includes multiple print heads 122, 123 arranged next to each other. For example, the first and second print bar 112, 113 have a mutually substantially equal or at least similar arrangement of print heads 122, 123 and/or print head dies. The pitch $d_n$ of the print bars 112, 113, which may also be referred to as print-bar-to-print-bar distance between corresponding points p1, p2 on the print bars 12, 13, is equal to a substrate advance distance $d_s$ corresponding to one complete turn of the idle pulley 110, or to a substrate advance distance $d_s$ corresponding to a higher integer number of complete turns of the idle pulley 110. The illustrated points p1, p2 are identical points on the first and second print bars 112, 113, for example corresponding to a border or particular nozzle of the print bar 112, 113, and are indicated for purpose of illustration, that is, the points p1, p2 are not necessarily physically present. In an example, a control circuit is configured so that one nozzle of a second print head 123 located in the second print bar 113 fires one ink drop at the same position as an ink drop fired by a corresponding nozzle of a corresponding first print head 122 located in the first print bar 112.

Figure 6:
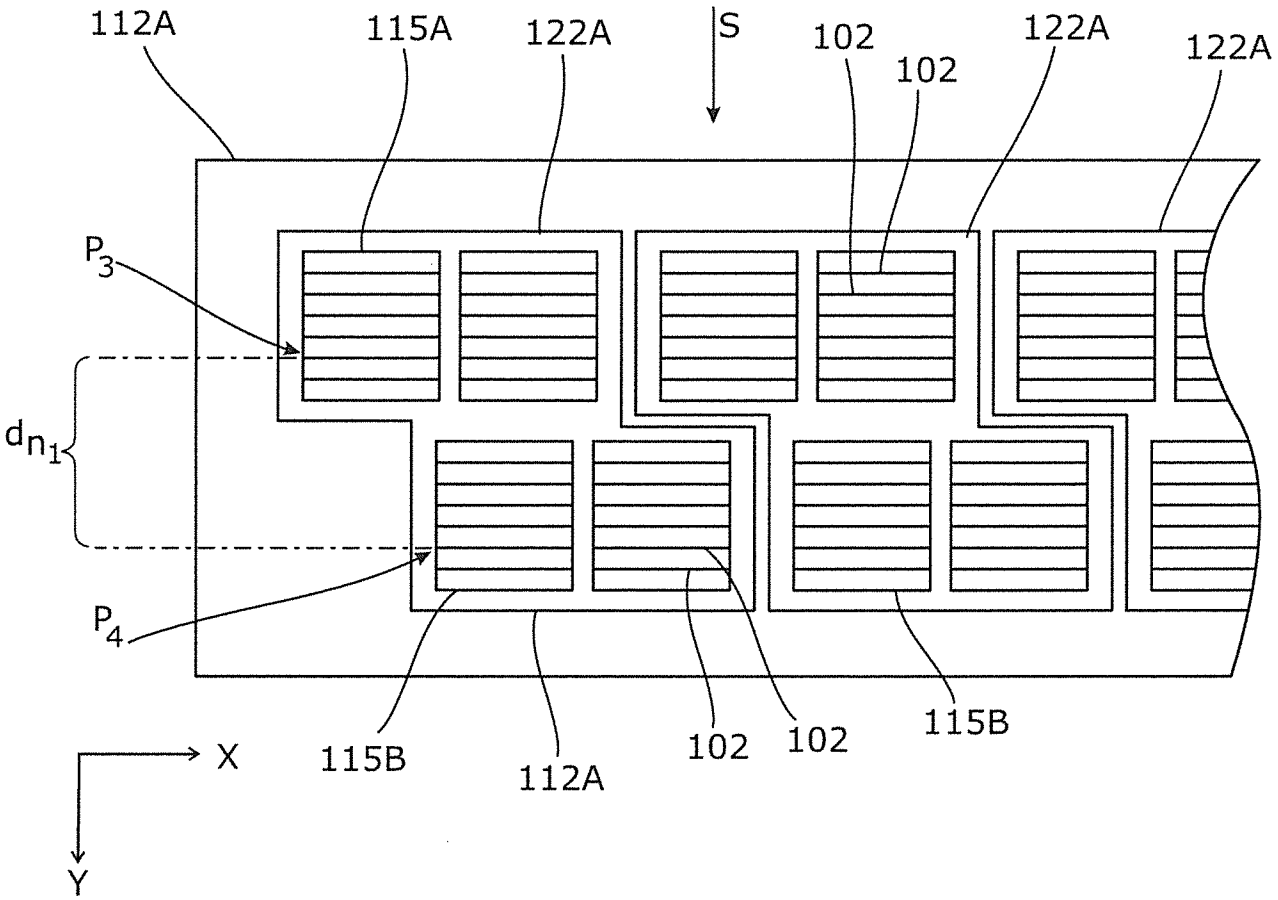
FIG. 6 illustrates a diagrammatic example of a portion of a print bar in a cross sectional top view.

As illustrated in the example of FIG. 6, an example print bar 112A can include multiple print heads 122A and multiple print head dies 115A, 115B, wherein each print head die 115A, 115B includes multiple nozzle arrays 102. For example, the print bar 112A of FIG. 6 represents one of the example first and second print bars 112, 113 of FIGS. 4 and 5. For example the print bar 112A includes one row of print heads 122A and multiple rows of print head dies 115A, 115B. For example, the print heads 122A are arranged in a staggered order, at least partially interlocking, overlapping, or in any other shape or regular arrangement. For example each print head 122A includes multiple print head dies 115A, 115B. For example, each print head die 115A, 115B includes multiple nozzle arrays 102. The illustrated example nozzle arrays 102 are arranged perpendicular to the substrate advance direction S.

In one example the pitch $d_{n1}$ of a first print head die 115A and a successive second print head die 115B, that is a distance between corresponding points p3, p4 of the print head dies 115A, 115B, as measured over an axis Y parallel to the substrate advance direction S, is equal to a substrate advance distance $d_s$ corresponding to one complete turn of the idle pulley 110, or to a substrate advance distance $d_s$ corresponding to a higher number of complete turns of the idle pulley 110, to compensate for a periodical error.

Figure 7:
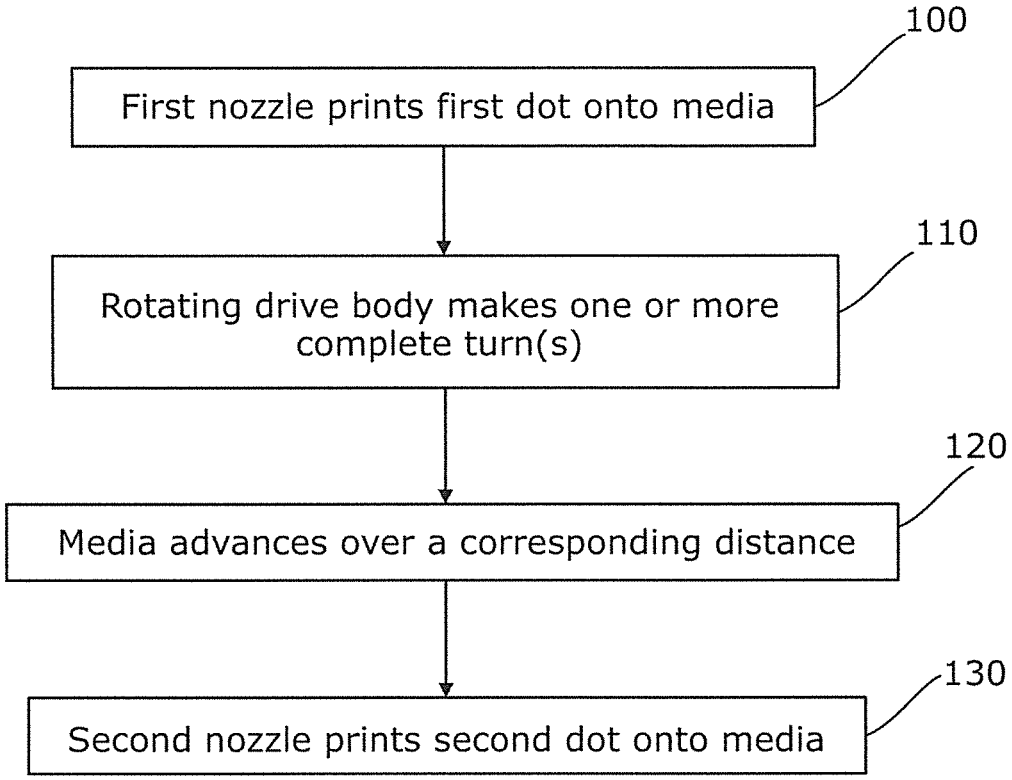
FIG. 7 illustrates a flow chart of an example of a method of ejecting fluid.

FIG. 7 illustrates a flow chart of an example method of ejecting fluid. In the example method, a first nozzle of the first nozzle array 2, 102 ejects a first dot onto the substrate 5A, 5B, 105 (block 100). In the example method, a rotating body 4 makes at least one 360 degrees turn t (block 110) so that the substrate 5A, 5B advances over a corresponding first distance $d_s$ (block 120). In the example method, a second nozzle that is located said first distance $d_s$ apart from the first nozzle ejects a second dot onto the substrate 5A, 5B, 105 (block 130). For example, the second dot arrives at the same location as the first dot. For example the first print bar 12, 112 and first nozzle array 2, 102 include said first nozzle and the second print bar 13, 113 and second nozzle array 3, 103 include said second nozzle, and said nozzle arrays 2, 3, 102, 103 and print bars 12, 13, 112, 113 are arranged over a pitch $d_n$, $d_{n1}$, that is equal to the substrate advance distance $d_s$ of one turn or a higher integer number of complete turns.

In certain examples the fluid includes ink or toner. In certain examples the fluid ejection device 1, 101 is a printer, for example a page wide array printer. For example, the substrate includes print media. In other examples any fluid or substrate can be used. For example, the dot on the substrate 5A, 5B, 105 consists of a fluid drop or printed spot. In an example, the fluid consists primarily of liquid. In other examples, the fluid includes both liquid and gas. For example, the fluid includes vapor or aerosol.

The above description is not intended to be exhaustive or to limit this disclosure to the examples disclosed. Other variations to the disclosed examples can be understood and effected by those of ordinary skill in the art from a study of the drawings, the disclosure, and the claims. The indefinite article "a" or "an" does not exclude a plurality, while a reference to a certain number of elements does not exclude the possibility of having more or less elements. A single unit may fulfil the functions of several items recited in the disclosure, and vice versa several items may fulfil the function of one unit. Multiple alternatives, equivalents, variations and combinations may be made without departing from the scope of this disclosure.

The invention claimed is:

1. A fluid ejection device, comprising
- a first nozzle array,
- a second nozzle array arranged downstream of the first nozzle array, and
- at least one rotating body for advancing a substrate with respect to the nozzle arrays, wherein
- a pitch of the first and second nozzle array equals a substrate advance distance corresponding to at least one complete turn of the rotating body.

2. The fluid ejection device of claim 1 wherein the at least one complete turn equals a single complete turn of 360 degrees.

3. The fluid ejection device of claim 1, comprising print bars, wherein the first nozzle array is arranged within a first print bar and the second nozzle array is arranged within a second print bar that is arranged downstream of, and parallel to, the first print bar.

4. The fluid ejection device of claim 1, wherein the pitch is a print bar pitch.

5. The fluid ejection device of claim 1, comprising print head dies, wherein the first nozzle array is arranged within a first print head die and the second nozzle array is arranged within a second print head die that is arranged downstream of the first print head die.

6. The fluid ejection device of claim 1, wherein the pitch is a print head die pitch.

7. The fluid ejection device of claim 1, comprising
- a control circuit for instructing
  - a first nozzle actuator to print a first dot out of a first nozzle of the first nozzle array onto a substrate, and
  - a second nozzle actuator to print a second dot out of a second nozzle of the second nozzle array onto the same location as the first dot.

8. The fluid ejection device of claim 1, comprising a belt, wherein the rotating body is a belt pulley.

9. The fluid ejection device of claim 8, wherein the belt pulley is idle.

10. The fluid ejection device of claim 1, comprising
- a substrate drive belt, and
- a pulley, the distance between the nozzle arrays being equal to a travel distance of the belt over one complete turn of the pulley.

11. A method of compensating for a registration error in a fluid ejection device by setting a pitch of a first nozzle array and a second nozzle array, arranged downstream of the first nozzle array, equal to a length that a substrate travels over at least one complete period of a periodic error function.

12. The method of claim 11 wherein the pitch is a pitch of print bars.

13. A method of ejecting fluid, comprising
- a first nozzle ejecting a first dot onto a substrate,
- a rotating body making at least one 360 degrees turn, a substrate advancing over a corresponding first distance, and
- a second nozzle said first distance apart from the first nozzle ejecting a second dot onto the substrate.

14. The method of ejecting fluid of claim 13 comprising printing the second dot onto the same location as the first dot.

15. The method of ejecting fluid of claim 13 comprising a first print bar comprising said first nozzle and a second print bar comprising said second nozzle, the second print bar being arranged parallel to and downstream of the first print bar.

* * * * *